US007160396B2

(12) United States Patent
Nishi

(10) Patent No.: US 7,160,396 B2
(45) Date of Patent: Jan. 9, 2007

(54) WASHING METHOD

(75) Inventor: Kazuyuki Nishi, Sakai (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 11/068,800

(22) Filed: Mar. 2, 2005

(65) Prior Publication Data

US 2005/0166947 A1 Aug. 4, 2005

Related U.S. Application Data

(62) Division of application No. 09/752,524, filed on Jan. 3, 2001, now Pat. No. 6,869,488.

(30) Foreign Application Priority Data

Jan. 7, 2000 (JP) ..... 2000-1472

(51) Int. Cl.
*B08B 3/00* (2006.01)

(52) U.S. Cl. ..... 134/26; 134/1; 134/27; 134/40; 134/42; 438/906

(58) Field of Classification Search ..... 134/1, 134/26, 31, 30, 29, 36, 25.4, 40, 2, 27, 42; 438/906

See application file for complete search history.

(56) References Cited

U.S. PATENT DOCUMENTS

| | | | | |
|---|---|---|---|---|
| 5,334,258 | A | 8/1994 | Osano et al. | |
| 5,397,397 | A * | 3/1995 | Awad | 134/1 |
| 5,490,894 | A | 2/1996 | Matsuhisa et al. | |
| 5,647,914 | A | 7/1997 | Goto et al. | |
| 5,667,594 | A * | 9/1997 | Omure et al. | 134/26 |
| 5,716,458 | A | 2/1998 | Machino | |
| 5,773,403 | A | 6/1998 | Hijino et al. | |
| 5,868,864 | A | 2/1999 | Nishi | |
| 5,876,461 | A * | 3/1999 | Racette et al. | 8/137 |
| 6,143,087 | A * | 11/2000 | Walter | 134/1 |
| 6,348,101 | B1 * | 2/2002 | Walter | 134/1 |
| 6,554,911 | B1 * | 4/2003 | King et al. | 134/26 |
| 6,869,488 | B1 * | 3/2005 | Nishi | 134/26 |

FOREIGN PATENT DOCUMENTS

| | | |
|---|---|---|
| DE | 4031563 | * 4/1992 |
| JP | 59-195654 | * 11/1984 |
| JP | 405266412 | 3/1992 |
| JP | 7-265817 | * 10/1995 |
| JP | 09-208995 | 9/1997 |

* cited by examiner

*Primary Examiner*—M. Kornakov
(74) *Attorney, Agent, or Firm*—McDermott Will & Emery LLP

(57) ABSTRACT

A washing method has a nonaqueous washing process of washing an object to be washed using a nonaqueous solution, an intermediate washing process of washing the object to be washed using a solution having solubility relative to both an aqueous solution and the nonaqueous solution after said nonaqueous washing process; and an aqueous washing process of washing the object to be washed with the aqueous solution after said intermediate washing process. When an intermediate washing process is performed between the nonaqueous washing process and the aqueous washing process, the nonaqueous solution adhered to the object to be washed in the nonaqueous washing process is removed in the intermediate washing process, and replaced by a solution having solubility relative to both the nonaqueous solution and the aqueous solution, so as to prevent the nonaqueous solution from being introduced into the aqueous solution used in the aqueous washing process.

12 Claims, 3 Drawing Sheets

WASHING METHOD

RELATED APPLICATION

This application is based on Patent Application No. 2000-1472 filed in Japan, the content of which is hereby incorporated by reference, and is a division of U.S. patent application Ser. No. 09/752,524, filed on Jan. 3, 2001, now U.S. Pat. No. 6,869,488.

BACKGROUND OF THE INVENTION

1. Field of the Invention

The present invention relates to a washing method for washing various types of parts including optical components such as lenses, mirrors and the like, and substrates used in optical/magnetic memory disks and the like, and specifically relates to a washing method for washing an object to be washed using an nonaqueous solution.

2. Description of the Related Art

Conventionally, when producing various types of components and optical elements such as lenses and the like, these components are washed to remove grease and debris adhered to the component during processing. Conventionally, chlorofluorocarbon solvent is widely used for washing such components, but its use is regulated due to problems of environmental pollution, and other solvents such as tetrachloroethylene and methylene chloride and the like are also being regulated due to concerns of environmental pollution.

For this reason in recent years washing methods are used wherein, after removing greasy stains such as cutting oils and pitch adhered to the object to be washed using a nonaqueous solution of hydrocarbon solvents and the like, the object to be washed is washed in an aqueous solution using an emulsifier or the like to remove the nonaqueous solution adhered to the object to be washed, and thereafter the object to be washed is finish washed using city water and pure water.

On the other hand, when the object to be washed is washed in an aqueous solution using an emulsifier or the like after the object to be washed has been washed using a nonaqueous solution, the aqueous solution is rapidly contaminated by an abundance of the nonaqueous solution introduced into the aqueous solution, such that the problem arises that the object to be washed cannot be suitably washed in the aqueous solution, and, therefore, the aqueous solution using an emulsifier must soon be replaced, which causes the further problems of lower work efficiency and higher running cost.

SUMMARY OF THE INVENTION

An object of the present invention is to provide a washing method for washing in an aqueous solution an object to be washed which has been washed using an improved nonaqueous solution.

An object of the present invention is to eliminate the problems arising when an object to be washed is washed in an aqueous solution after greasy stains such as cutting oil and pitch adhered to the object to be washed have been removed using a nonaqueous solution.

Specifically, when an object to be washed has been washed using a nonaqueous solution and thereafter washed in an aqueous solution, the rapid deterioration of the aqueous solution caused by the introduction of the nonaqueous solution into the aqueous solution is controlled so as to provide suitable washing of the object to be washed by the aqueous solution over a long period, thereby improving the work efficiency of washing the object to be washed and reducing the running cost.

These objects are attained by a washing method described below.

A washing method comprising a nonaqueous washing process of washing an object to be washed using a nonaqueous solution, and an aqueous washing process of washing an object to be washed with an aqueous solution after the aforesaid nonaqueous washing process, wherein an intermediate washing process of washing an object to be washed using a solution having solubility relative to both the aqueous solution and the nonaqueous solution is performed between the nonaqueous washing process and the aqueous washing process.

When an intermediate washing process of washing an object to be washed using a solution having solubility relative to both the aqueous solution and the nonaqueous solution is performed between the nonaqueous washing process and the aqueous washing process as in the aforesaid washing method, the nonaqueous solution adhered to the object to be washed in the nonaqueous washing process is removed in the intermediate washing process, and replaced by a solution having solubility relative to both the nonaqueous solution and the aqueous solution, so as to prevent the nonaqueous solution from being introduced into the aqueous solution used in the aqueous washing process.

For this reason rapid deterioration of the aqueous solution used in the aqueous washing process is controlled, and washing of an object to be washed using this aqueous solution is accomplished with stability over a long period, replacement of the aqueous solution is reduced, and the work of washing the object to be washed is achieved efficiently while the running cost is reduced.

When an intermediate washing process of washing an object to be washed using a solution having solubility relative to both the aqueous solution and the nonaqueous solution is performed between the nonaqueous washing process and the aqueous washing process and a drying process of drying the object to be washed is performed before and/or after the intermediate washing process, the nonaqueous solution remaining on the object to be washed and in the container accommodating the object to be washed is dried and removed, so as to prevent the nonaqueous solution from being introduced into the aqueous solution used in the aqueous washing process.

Although various drying methods may be used to dry the object to be washed before and/or after the intermediate washing process as described above, greater prevention of the nonaqueous solution being introduced into the aqueous solution used in the aqueous washing process is achieved when the object to be washed is dried using the vapor a solution having solubility relative to both the nonaqueous solution and the aqueous solution.

Another washing method comprising a nonaqueous washing process of washing an object to be washed using a nonaqueous solution, and an aqueous washing process of washing an object to be washed with an aqueous solution after the aforesaid nonaqueous washing process, wherein an intermediate washing and drying process of washing an object to be washed using a vapor of a solution having solubility relative to both the nonaqueous solution and the aqueous solution and drying the object to be washed is performed between the aforesaid nonaqueous washing process and the aqueous washing process.

Another mode of the washing method provides that when an intermediate washing and drying process of washing an object to be washed using a vapor of a solution having solubility relative to both the nonaqueous solution and the aqueous solution and drying the object to be washed is performed between the aforesaid nonaqueous washing process and the aqueous washing process, the nonaqueous solution adhered to the object to be washed in the nonaqueous washing process is removed by the aforesaid vapor and the object to be washed is dried, and the introduction of nonaqueous solution used in the nonaqueous washing process into the aqueous solution used in the aqueous washing process is prevented in a short time.

In the washing method of the present invention, well known nonaqueous solutions used in conventional washing may be used as the nonaqueous solution used in the previously mentioned nonaqueous washing process, but it is desirable to use a hydrocarbon solution having few problems in terms of environmental pollution.

BRIEF DESCRIPTION OF THE DRAWINGS

These and other objects and features of this invention will become clear from the following description taken in conjunction with the preferred embodiments with reference to the accompanying drawings, in which.

DESCRIPTION OF THE PREFERRED EMBODIMENTS

The embodiments of the washing method of the present invention are described in detail hereinafter with reference to the accompanying drawings.

First Embodiment

Figure 1:
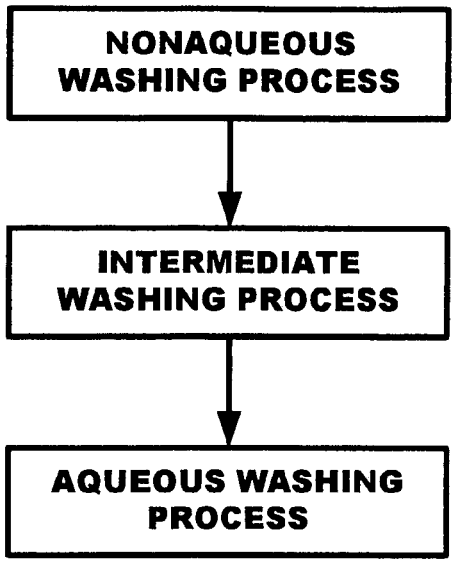
FIG. 1 is the process of the washing method of a first embodiment of the present invention.

In the washing method of the first embodiment, as shown in FIG. 1, after a nonaqueous washing process is performed to wash an object to be washed using a nonaqueous solution, an intermediate washing process is performed to wash the object to be washed using a solution having solubility relative to both the nonaqueous solution and an aqueous solution, and thereafter an aqueous washing process is performed to wash the object to be washed using an aqueous solution.

Examples of usable solutions having solubility relative to both the nonaqueous solution and the aqueous solution used in the intermediate washing process include alcohols such as isopropyl alcohol and the like, and ketones such as acetone and the like.

In the aqueous washing process wherein an object to be washed which has already been subjected to the intermediate wash is further washed using an aqueous solution, the object to be washed is washed in an aqueous solution using an emulsifier or the like as is generally used conventionally, and the object which has been washed in the aqueous solution using an emulsifier or the like is then finish washed using city water or pure water.

It is desirable that ultrasonic vibration is applied during the washing performed in the nonaqueous washing process, intermediate washing process, and aqueous washing process to achieve excellent washing of the object to be washed.

Second and Third Embodiments

Figure 2:
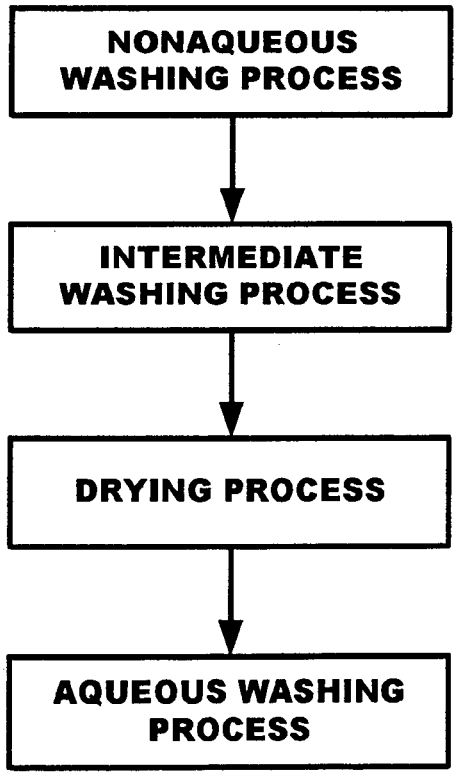
FIG. 2 is the process of the washing method of a second embodiment of the present invention.

In the washing method of the second embodiment shown in FIG. 2, after the nonaqueous washing process is performed to wash an object to be washed using a nonaqueous solution, an intermediate washing process is performed to wash the object to be washed using a solution having solubility relative to both the nonaqueous solution and an aqueous solution, then a drying process is performed to dry the object which has been subjected to the intermediate wash, and thereafter an aqueous washing process is performed to wash this object to be washed using an aqueous solution.

Figure 3:
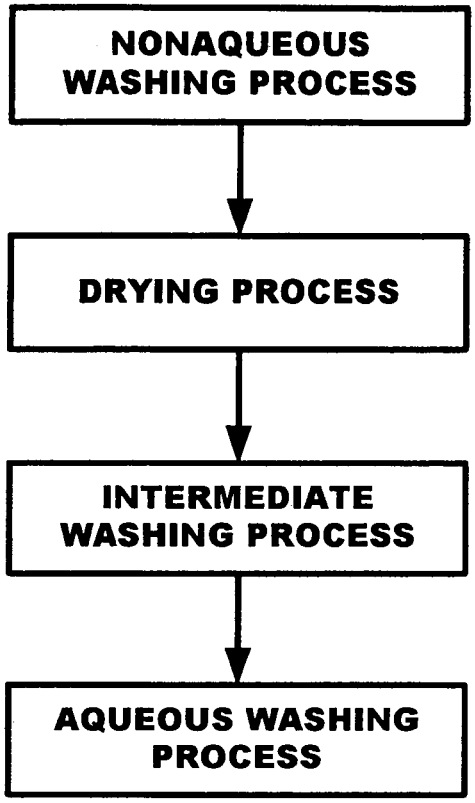
FIG. 3 is the process of the washing method of a third embodiment of the present invention.

In the washing method of the third embodiment shown in FIG. 3, after a nonaqueous washing process is performed to wash an object to be washed using a nonaqueous solution, a drying process is performed to dry the object to be washed, and thereafter an intermediate washing process is performed to wash the dried object to be washed using a solution having solubility relative to both the nonaqueous solution and an aqueous solution, and thereafter an aqueous washing process is performed to wash the object to be washed using an aqueous solution.

In the drying process of the second and third embodiments, various drying methods may be used insofar as the object to be washed is dried thereby, but when the object to be washed is dried using a vapor of the solution having solubility to both the nonaqueous solution and the aqueous solution, the nonaqueous solution adhered to the object to be washed is removed by the vapor of the aforesaid solubility solution, thereby providing even greater prevention of the nonaqueous solution being introduced into the aqueous solution used in the aqueous washing process.

Fourth Embodiment

Figure 4:
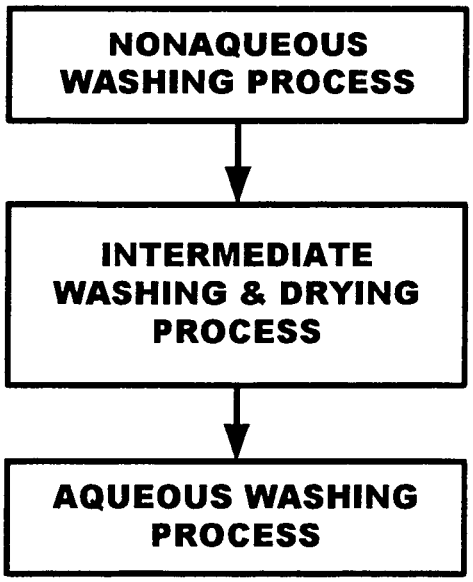
FIG. 4 is the process of the washing method of a fourth embodiment of the present invention.

In the washing method of the fourth embodiment shown in FIG. 4, a nonaqueous washing process is performed to wash an object to be washed using a nonaqueous solution, and thereafter an intermediate washing and drying process is performed to wash the object to be washed using a solution having solubility relative to both the nonaqueous solution and an aqueous solution and to dry the object to be washed, and thereafter an aqueous washing process is performed to wash the object to be washed using an aqueous solution. Specific examples and comparative examples of the washing method of the present invention are described below to clarify the suppression of contamination of the aqueous solution by the nonaqueous solution and the stability of long term washing of the object to be washed using the aqueous solution.

One hundred lens elements having a diameter of 22.5 mm and thickness of 1 mm were used as the object to be washed and accommodated in a container used for washing.

Figure 5:
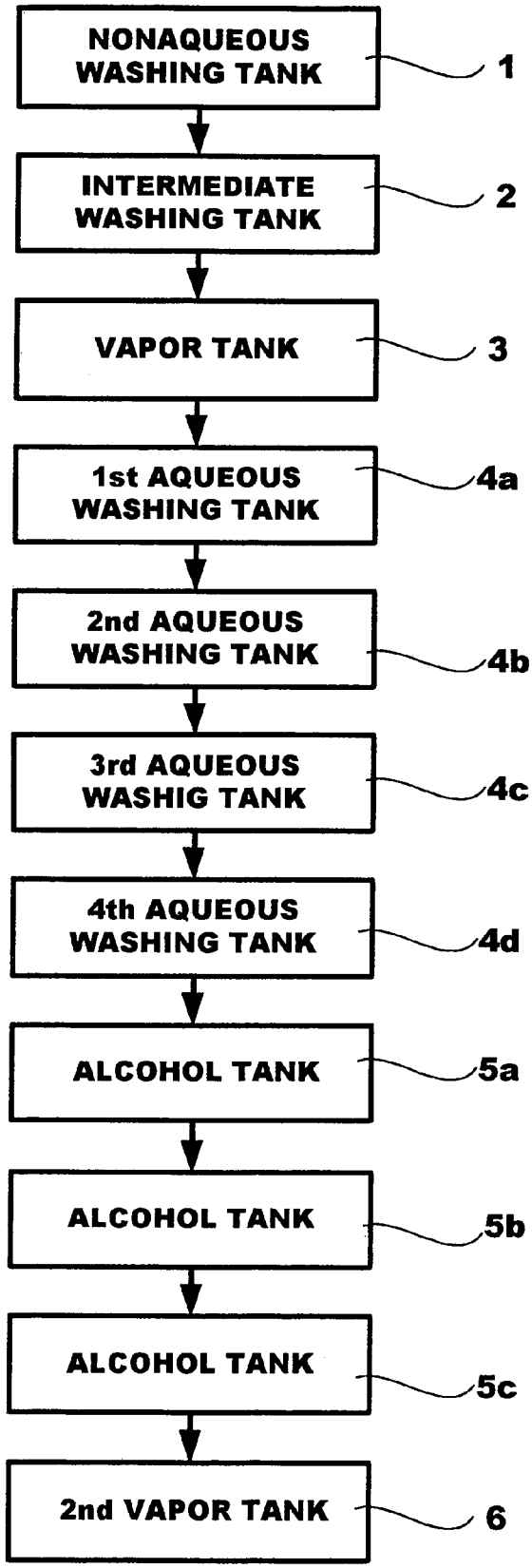
FIG. 5 briefly illustrates the an example of the washing method of the present invention.

The washing method used in this example corresponds to the washing method of the second embodiment. As shown in FIG. 5, the container accommodating 100 lens elements was first immersed in a nonaqueous washing tank 1 holding a hydrocarbon nonaqueous solution, ultrasonic vibration was applied, and the lens elements within the container were washed by the nonaqueous solution.

Then, the container was immersed in an intermediate washing tank 2 holding isopropyl alcohol as a solution having solubility relative to both the nonaqueous solution and an aqueous solution, ultrasonic vibration was applied, and the lens elements were washed so as to remove the residual hydrocarbon nonaqueous solution remaining in the container and on the lens elements.

Then, the container was introduced into a vapor tank 3 holding vapor of isopropyl alcohol used as a solution having solubility relative to both the hydrocarbon nonaqueous solution and the aqueous solution, and the container and the lens elements were washed by the isopropyl alcohol vapor to remove the residual hydrocarbon nonaqueous solution from the container and the lens elements and dry the container and the lens elements.

Then, when washing the dried container and lens elements using an aqueous solution, first, the container was immersed in a first aqueous washing tank 4*a* holding an aqueous solution using an emulsifier, and ultrasonic vibration was applied to remove minerals and stains adhered to the lens elements within the container. Then, the container was immersed in a second aqueous washing tank 4*b* holding city water, and ultrasonic vibration was applied to remove the residual emulsifier remaining in the container and on the lens elements, and thereafter the container was sequentially immersed in a third aqueous washing tank 4*c* and a fourth aqueous washing tank 4*d* holding pure water, and ultrasonic vibration was applied to remove ions and the like adhered to the lens elements.

Furthermore, after the lens elements accommodated in the container were washed using the aqueous solution, the container was sequentially immersed in three alcohol tanks 5*a*, 5*b*, 5*c*, holding isopropyl alcohol, and ultrasonic vibration was applied to remove moisture adhere to the container and the lens elements, and thereafter the container was introduced into a second vapor tank 6 using isopropyl alcohol vapor to remove moisture adhered to the container and the lens elements and dry the container and the lens elements.

In a comparative example, the intermediate washing tank 2 and the vapor tank 3 of the previous example were omitted, and the container accommodating the lens elements was immersed in the nonaqueous washing tank 1 holding a hydrocarbon nonaqueous solution, and ultrasonic vibration was applied for washing. Thereafter the container was directly immersed in the first aqueous washing tank 4*a* holding an aqueous solution using an emulsifier, and ultrasonic vibration was applied for washing, and thereafter the washing procedure was identical to that of the previous example.

Although insufficient washing did not occur even after the container accommodating the lens elements was washed 3,000 times using the washing procedure of the example, in the washing procedure of the comparative example, slight washing insufficiency occurred after the container accommodating the lens elements was washed 160 times, and severely poor cleaning occurred after 300 washings.

Similar effectiveness to the aforesaid example using the washing method of the second embodiment was achieved when using the washing methods of the first, third, and fourth embodiments.

Although lens elements were used as the objects to be washed in the aforesaid example, the washing method is also applicable to washing electrically conductive substrates and the like formed of aluminum and the like used in the photoconductive body of electrophotographic apparatuses. And then, the washing method is also applicable to washing substrates and the like formed of aluminum or ceramic glass material and the like used in the magnetic memory disc.

The washing method of the example described above comprised a nonaqueous washing process of washing an object to be washed using a nonaqueous solution, an aqueous washing process of washing an object to be washed with an aqueous solution after the aforesaid nonaqueous washing process, and an intermediate washing process of washing an object to be washed using a solution having solubility relative to both the aqueous solution and the nonaqueous solution performed between the nonaqueous washing process and the aqueous washing process, and an intermediate washing and drying process of washing an object to be washed using a vapor of a solution having solubility relative to both the nonaqueous solution and the aqueous solution and drying the object to be washed, such that the nonaqueous solution adhered to the object to be washed in the nonaqueous washing process is removed in the intermediate washing process and the intermediate washing and drying process, thereby preventing the nonaqueous solution from being introduced into the aqueous solution during the aqueous washing process.

As a result, the washing method of the example suppressed rapid degradation of the aqueous solution used in the aqueous washing process, provided long term stability in the washing of the object to be washed using the aqueous solution, reduced replacement of the aqueous solution, and improved the efficiency of the work of washing the object to be washed as well as reducing the running cost.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method of washing an object, wherein the object is an optical component, said method comprising the steps of:

a nonaqueous washing process of washing the object to be washed using a hydrocarbon solution;

an intermediate washing and drying process of simultaneously washing and drying the object using a vapor of a solution having solubility relative to both an aqueous solution and the nonaqueous solution after said nonaqucous washing process; and an aqueous washing process of washing the object using the aqueous solution after said intermediate washing and drying process.

2. A washing method as claimed in claim 1, wherein the intermediate washing and drying process is performed by using a vapor of alcohol.

3. A washing method as claimed in claim 2, wherein the alcohol used in the intermediate washing and drying process is isopropyl alcohol.

4. A washing method as claimed in claim 1, wherein ultrasonic vibration is applied in at least one of the nonaqueous washing process and the aqueous washing process.

5. A washing method as claimed in claim 1, wherein the intermediate washing and drying process is performed by using a vapor of ketone.

6. A washing method as claimed in claim 5, wherein the ketone used in the intermediate washing and drying process is acetone.

7. A method of washing an object, wherein the object is an optical component, said method comprising the steps of:

(A) washing an object to be washed using a hydrocarbon solution;

(B) washing and drying the object using a vapor of a solution having solubility relative to both an aqueous solution and the hydrocarbon solution after the step (A);

(C) washing the object using an aqueous solution including an emulsifier after the step (B); and (D) washing the object using a water after the step (C).

8. A washing method as claimed in claim 7, wherein the washing and drying process in the step (B) is performed by using a vapor of alcohol.

9. A washing method as claimed in claim 8, wherein said alcohol used in the step (B) is isopropyl alcohol.

10. A washing method as claimed in claim 7, wherein ultrasonic vibration is applied in at least one of the steps (A), (C) and (D).

11. A washing method as claimed in claim 7, wherein the washing and drying process in the step (B) is performed by using a vapor of ketone.

12. A washing method as claimed in claim 8, wherein said ketone used in the step (B) is acetone.

* * * * *